US008595966B2

(12) United States Patent
Breihof

(10) Patent No.: US 8,595,966 B2
(45) Date of Patent: Dec. 3, 2013

(54) SIGN ASSEMBLY

(75) Inventor: Thomas C. Breihof, Belmont, MI (US)

(73) Assignee: SignComp, LLC, Grand Rapids, MI (US)

( * ) Notice: Subject to any disclaimer, the term of this patent is extended or adjusted under 35 U.S.C. 154(b) by 0 days.

(21) Appl. No.: 13/268,247

(22) Filed: Oct. 7, 2011

(65) Prior Publication Data

US 2012/0085008 A1 Apr. 12, 2012

Related U.S. Application Data

(60) Provisional application No. 61/392,191, filed on Oct. 12, 2010.

(51) Int. Cl.
*G09F 17/00* (2006.01)

(52) U.S. Cl.
USPC ..... 40/603; 15/231

(58) Field of Classification Search
USPC ..... 40/603; 160/374.1
See application file for complete search history.

(56) References Cited

U.S. PATENT DOCUMENTS

| | | | |
|---|---|---|---|
| 793,967 | A | 7/1905 | Upperman |
| 2,528,332 | A | 10/1950 | Bergquist |
| 2,722,071 | A | 11/1955 | Paschal |
| 3,099,855 | A | 8/1963 | Nash |
| 3,373,546 | A | 3/1968 | Setnan |
| 3,760,450 | A | 9/1973 | Griffin et al. |
| 3,783,931 | A | 1/1974 | Assael |
| 3,877,103 | A | 4/1975 | Nash |
| 4,542,605 | A | 9/1985 | Gandy |
| 4,674,213 | A | 6/1987 | Keithley |
| 4,937,961 | A | 7/1990 | Gandy et al. |
| 4,974,298 | A | 12/1990 | Thallon |
| 4,991,250 | A | 2/1991 | Young |
| 5,033,216 | A | 7/1991 | Gandy et al. |
| 5,040,586 | A | 8/1991 | Hillstrom |
| 5,255,459 | A | 10/1993 | Verret |
| 5,467,546 | A | 11/1995 | Kovalak, Jr. |
| 5,522,635 | A | 6/1996 | Downey |
| 5,896,689 | A | 4/1999 | Bassouls et al. |

(Continued)

FOREIGN PATENT DOCUMENTS

| | | |
|---|---|---|
| CA | 2159368 | 3/1997 |
| CA | 2207949 A1 | 12/1998 |

OTHER PUBLICATIONS

European Search Report from corresponding European Patent Application No. 11184484.1, dated Oct. 3, 2012, which corresponds to U.S. Appl. No. 13/268,247.

*Primary Examiner* — J. Allen Shriver, II
*Assistant Examiner* — Shin Kim
(74) *Attorney, Agent, or Firm* — Gardner, Linn, Burkhart & Flory, LLP

(57) ABSTRACT

A sign assembly includes a substantially rigid framework such as a rectangular or other shaped frame, and a flexible display sheet, typically of cloth or fabric material. The display sheet wraps around an outer portion of the framework and enters a channel, where it is retained at a flexible retainer element disposed in the channel. Optionally, the flexible retainer element may be a strip of resilient sheet material defining one or more slit or slot patterns and/or openings that are configured to releasably engage portions of the display sheet. A cover element may be used to cover the channel and to present a finished appearance along the outside portion of the framework.

22 Claims, 11 Drawing Sheets

(56) References Cited

U.S. PATENT DOCUMENTS

| | | | | |
|---|---|---|---|---|
| 6,061,941 | A | 5/2000 | Verret | |
| 6,073,376 | A | 6/2000 | Verret | |
| 6,112,444 | A * | 9/2000 | Milliken et al. | 40/603 |
| 6,263,949 | B1 | 7/2001 | Guthrie, Jr. | |
| 6,305,046 | B1 | 10/2001 | Kingry et al. | |
| 6,484,346 | B2 | 11/2002 | Kingry et al. | |
| 6,637,080 | B2 | 10/2003 | Verret | |
| 6,651,290 | B2 | 11/2003 | Kingry et al. | |
| 7,487,610 | B2 * | 2/2009 | Milliken et al. | 40/541 |
| 7,552,499 | B2 | 6/2009 | James et al. | |

* cited by examiner

SIGN ASSEMBLY

CROSS REFERENCE TO RELATED APPLICATION

The present application claims the priority benefit of U.S. provisional application Ser. No. 61/392,191, filed Oct. 12, 2010, which is hereby incorporated herein by reference in its entirety.

FIELD OF THE INVENTION

The present invention is directed to signage and, more specifically, to signs including framework for supporting flexible display surfaces.

BACKGROUND OF THE INVENTION

Cloth or fabric signs tend to be more durable than paper-based signs, resist permanent creases, and can be less expensive than other materials commonly used for signs, such as plastic sheet materials. One of the challenges in providing a satisfactory display surface made of cloth or fabric sheet material is ensuring that there are no wrinkles that could detract from the appearance of the sign. Another challenge is reducing the effort or difficulty of working with fabrics that generally do not hold a fixed shape unless they are held taut.

SUMMARY OF THE INVENTION

The present invention provides a sign assembly that facilitates the smooth mounting or supporting of a cloth or fabric sheet having a display surface, and that substantially hides a framework to which the fabric sheet is mounted. In the present application, the terms "cloth" and "fabric" are used synonymously, and refer to substantially any woven or non-woven flexible sheet material of natural or synthetic material. The sign assembly of the present invention includes a framework, such as a rectangular framework or a framework having another shape, including openings defined in a resilient strip of material associated with the framework. Portions of the perimeter of the display sheet can be pushed into the openings so that the sheet portions are retained in those openings, which can be readily accomplished by an installer using a finger or a blunt tool. This action retains the display sheet at the framework once the finger or tool is removed. Once the display sheet is mounted to the framework, the sheet remains adjustable or replaceable by releasing and resetting portions of the perimeter region of the display sheet at the individual openings of the framework, and optionally without need for tools.

According to one form of the present invention, a sign assembly includes a framework having at least one frame member defining a perimeter region, the frame member including a plurality of flexible retainer elements. Each of the flexible retainer elements is made of a flexible and resilient sheet material defining at least one opening or seam, such as a slit, a slot, or a hole. The sign assembly further includes a display sheet having an outer perimeter region with an engagement portion made of a flexible material. The flexible retainer elements are configured to releasably engage the engagement portion of the display sheet when regions of the engagement portion are urged at least partially through the openings of the flexible retainer elements.

In one aspect, the engagement portion of the display sheet includes an outer perimeter region of the display sheet.

Optionally, at least the engagement portion of the display sheet is a fabric or fabric-like material.

In another aspect, the entire display sheet is made of the flexible fabric material.

In still another aspect, the framework includes left and right frame members spaced from one another, and top and bottom frame members spaced from one another. The top and bottom frame members are joined to the left and right frame members to form a rectangular frame.

In a further aspect, the flexible retainer element includes at least one slot pattern defined between a plurality of flexible finger portions in a flexible strip. The flexible finger portions deflect at the slot pattern to form an opening when the engagement portion of the display sheet is urged at least partially through the slot pattern. Optionally, the flexible retainer element includes a repeating series of the slot patterns in the flexible strip. The flexible retainer element may further include a weakened portion between adjacent slot patterns, so that the weakened portion can be broken or torn apart, if desired, to join the adjacent slot patterns together. Optionally, the flexible retainer element is arranged substantially parallel to the outer surface of the frame member.

In a further aspect, the sign assembly includes a cover element that engages the frame member to cover the channel. Optionally, the cover element is snap-fit to the frame member, and sandwiches or clamps a portion of the display sheet between the cover element and a portion of the frame member, to at least partially retain the display sheet at the frame member. Optionally, the cover element is pivotally coupled to the frame member and is movable between an open position in which the channel is exposed, and a closed position in which the channel is covered by the cover element.

According to another form of the present invention, a sign assembly includes a framework, a flexible retainer element, and a display sheet. The framework defines a perimeter region and includes at least one frame member having an outer surface that defines a channel. The flexible retainer element is mounted in the channel of the frame member. The display sheet includes a display portion and an engagement portion, where at least the engagement portion of the display sheet is made of a flexible fabric or fabric-like material. The portion of the display sheet near the engagement portion is positioned over at least a portion of the outer surface of the frame member, with at least the engagement portion of the display sheet disposed in the channel of the frame member. The flexible retainer element is configured to releasably engage the engagement portion of the display sheet when the engagement portion of the sheet is urged at least partially through the flexible retainer element.

According to another form of the present invention, a sign assembly includes a framework defining a perimeter region and having at least one frame member, a plurality of flexible retainer elements at the frame member, and a display sheet. Each of the flexible retainer elements is an opening, or a slit, or a slot formed in a flexible and resilient sheet material. The display sheet includes an engagement portion made of flexible fabric or fabric-like material. The flexible retainer elements are configured to releasably engage the engagement portion of the display sheet when regions of the engagement portion are urged at least partially through respective ones of the flexible retainer elements.

According to yet another form of the present invention, a method is provided for assembling a sign including a fabric display sheet. The method includes wrapping an outer perimeter region of the display sheet around outer surfaces of a framework, urging a plurality of portions of the perimeter region of the display sheet into respective ones of a plurality of flexible retainer elements disposed along the framework, and releasably retaining the portions of the perimeter region of the display sheet at the respective retainer elements.

Accordingly, the sign assembly of the present invention permits the display of a cloth or fabric sign so that a framework associated with the sign is substantially hidden from view, and so that any wrinkles in the cloth sign material can be readily removed. The cloth sign material can be readily installed or replaced along the framework, either with or without removing the framework from a wall or other support surface, and optionally without the use of tools.

These and other objects, advantages, purposes, and features of the invention will become more apparent upon review of the following specification in conjunction with the drawings.

DESCRIPTION OF THE PREFERRED EMBODIMENTS

Figure 1:
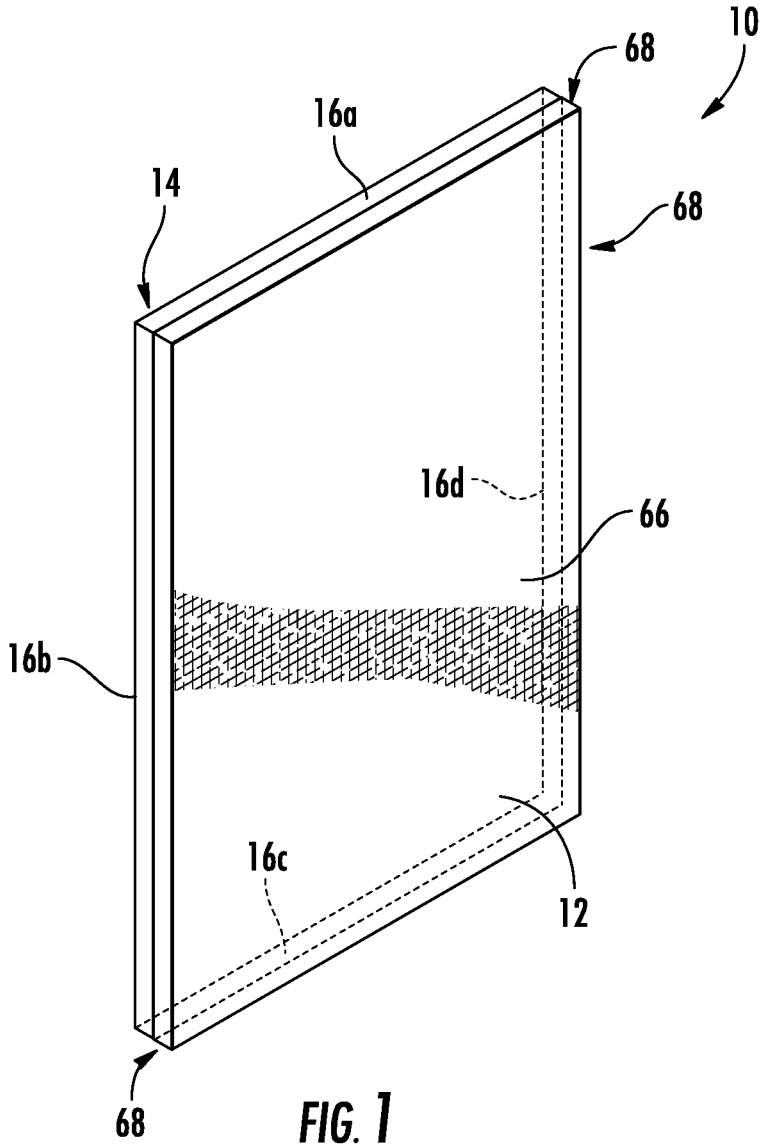
FIG. 1 is a perspective view of a sign assembly in accordance with the present invention.

Referring now to the drawings and the illustrative embodiments depicted therein, a sign assembly 10 permits the display of a flexible display sheet 12, which is at least partially made from cloth, fabric, or a similar flexible sheet material (FIG. 1). Display sheet 12 may have lettering, art work, or other printing applied to it, so that the sheet 12 can be used to display advertisements, messages, images, or the like. Display sheet 12 is held taut by a framework 14, which includes a plurality of frame members 16. In the illustrated embodiment of FIG. 1, frame members 16 include top (16*a*), left (16*b*), bottom (16*c*), and right (16*d*) frame members arranged so that framework 14 is rectangular, although it will be appreciated that the frame members may be arranged into other shapes. Framework 14 releasably retains the display sheet 12 by engaging portions of the sheet along its perimeter, in a manner that allows the sheet to be readily attached, adjusted, and detached along the frame members, while presenting a clean outward appearance of the finished sign assembly.

In the illustrated embodiment, each frame member 16*a-d* is an extruded member, such as aluminum or another readily-extruded material, and has a substantially constant cross section along its length. Each frame member includes outer or outwardly-facing surfaces 18, inner or inwardly-facing surfaces 20, and rear or rearwardly-facing surfaces 22. For example, and with reference to FIG. 2, left frame member 16*b* includes a generally inwardly-facing surface 20*b*, an outwardly-facing surface 18*b*, and a rearwardly-facing surface 22*b*, while bottom frame member 16*c* includes an inwardly-facing surface 20*c*, an outwardly-facing surface 18*c*, and a rearwardly-facing surface 22*c*. In the foregoing description, each frame member 16*a-d* is substantially identical to every other frame member (except possibly in length), so that while each frame member 16*a-d* has its own features or elements, referred to herein with reference numerals ending in the same suffix a, b, c, and d (e.g. top frame member 16*a* includes an outwardly-facing surface 18*a*), it will be appreciated that a given feature described in connection with an illustrated frame member 16 is included on every frame member unless otherwise noted, and these common features may be referenced herein either with or without a suffix. For simplicity, only certain frame members are shown in the drawings; it being understood that the same or similar features or aspects are generally included on each other frame member.

Figure 2:
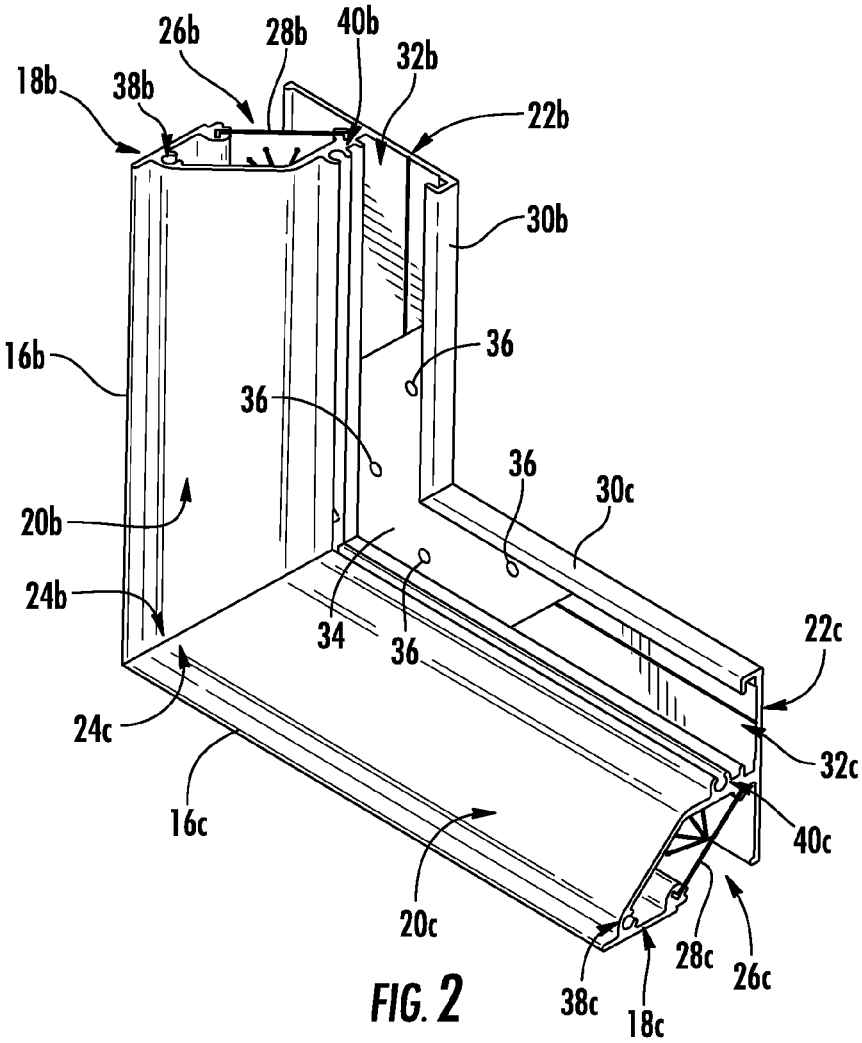
FIG. 2 is a perspective view of a lower-left corner portion of the framework of the sign assembly of FIG. 1.

In the illustrated embodiment, each frame member 16 has opposite ends 24 (ends 24*b* and 24*c* are shown in FIG. 2) that are each mitered at an angle of 45 degrees to present a clean, finished appearance and a 90-degree corner where each frame member meets an adjacent frame member. It will be appreciated that, as an alternative, the ends of each frame member could be cut or mitered at a different angle to create frameworks in other shapes, such as non-rectangular, polygonal shapes. It is further envisioned that, while the illustrated frame members 16*a-d* are generally straight, one or more frame members could be curved to provide an arcuate portion of a framework, or even to produce an oval or circular framework, as desired. Optionally, it is envisioned that display sheet 12 could be supported in a hanging manner by only one frame member 16, or could span between two or more frame members that are coupled together or separately mounted in substantially fixed spacing, without departing from the spirit and scope of the present invention.

Referring again to FIG. 2, outer surfaces 18*b*, 18*c* are generally planar and define the outer perimeter of framework 14. Outer surfaces 18*b*, 18*c* are spaced outwardly or forwardly from rearwardly-facing surfaces 22*b*, 22*c*, to form respective channels 26*b*, 26*c* in which respective flexible retainer elements 28*b*, 28*c* are supported, as will be described below. Rearwardly-facing surfaces 22*b*, 22*c* are formed by respective backing elements 30*b*, 30*c* of frame members 16*b*, 16*c*. Backing elements 30*b*, 30*c* also form channels 32*b*, 32*c* along inwardly-facing surfaces 20*b*, 20*c*, each channel 32*b*, 32*c* for receiving a respective portion of an L-shaped corner bracket 34 at the junction between mitered opposite ends 24*b*, 24*c*. L-shaped corner bracket 34 is a conventional bracket such as may be used in metal picture frame construction, and includes a plurality of threaded bores 36 for receiving respective threaded fasteners (not shown), which are tightened in the bores 36 to secure the L-shaped corner bracket 34 in the channels 32*b*, 32*c* formed by backing elements 30*b*, 30*c*. In this manner, corner brackets 34 couple adjacent frame members 16 together, and stabilize the mitered joint.

Figure 3:
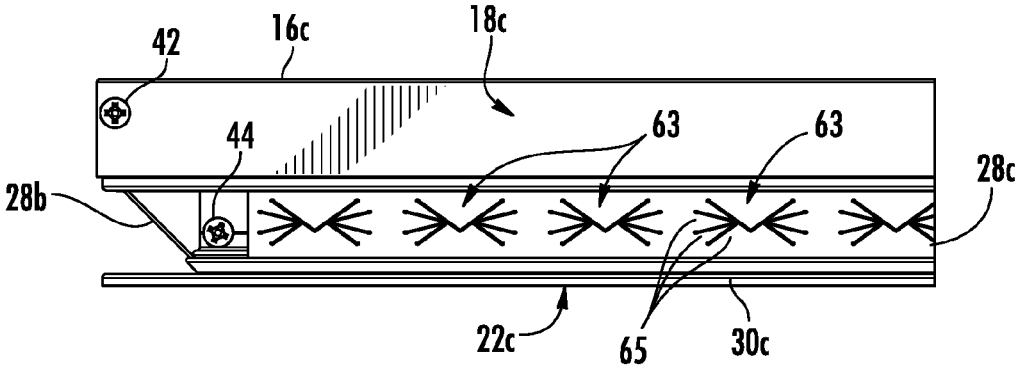
FIG. 3 is a bottom plan view of a bottom frame member of the sign assembly.

To further secure the framework, each of the frame members 16*b*, 16*c* includes two screw bosses 38*b*, 40*b* and 38*c*, 40*c* that are formed as semi-tubular channels in each frame member, as best shown in FIGS. 4A-5B. As shown in FIG. 3, the screw bosses facilitate assembly of the framework 14 by permitting the attachment of respective frame members at their mitered opposite ends using threaded fasteners, including front screws 42 and rear screws 44. As shown in FIG. 3, front screw 42 is disposed in a through-hole (not shown) in outer surface 18*c* of frame member 16*c*, and is threadedly engaged (such as in a self-tapping manner) with front screw boss 38*b* of frame member 16*b*. Similarly, rear screw 44 is disposed in a through-hole (not shown) near a portion of flexible retainer element 28*c* and backing element 30*c*, so that rear screw 44 threadedly engages (by self-tapping) rear screw boss 40*b* of frame member 16*b*. As noted above, each frame member may be made from softer metals such as aluminum, in part to facilitate self-tapping engagement by a threaded fastener, although it is envisioned that other molded, machined, or extruded materials, including other metals or even non-metals, could be used.

Optionally, the frame members of each framework can be scaled up or down in size, or varied in length, as appropriate, to accommodate different sizes of display sheets and/or display locations. It will be appreciated that the profile(s) of the frame member(s) can be varied significantly according to the needs of a particular installation, without departing from the spirit and scope of the present invention. For example, screw bosses and L-shaped mounting brackets may be eliminated or supplemented with the use of other joining methods, such as welding, bonding with adhesives, interlocking parts, or the like, for attaching frame members to one another.

Thus, framework 14 can be assembled from a plurality of substantially identical, straight frame members 16*a*-*d* using threaded fasteners 42, 44 and corner brackets 34. It will be appreciated that while the foregoing description of framework 14 is directed to the features and joining elements of left frame member 16*b* and bottom frame member 16*c*, as shown in FIGS. 2 and 3, the top frame member 16*a* may be joined to left and right frame members 16*b*, 16*d* in a substantially identical manner, and the right frame member 16*d* may likewise be joined to the top frame member 16*a* and bottom frame member 16*c* in a substantially identical manner.

Figure 4A:
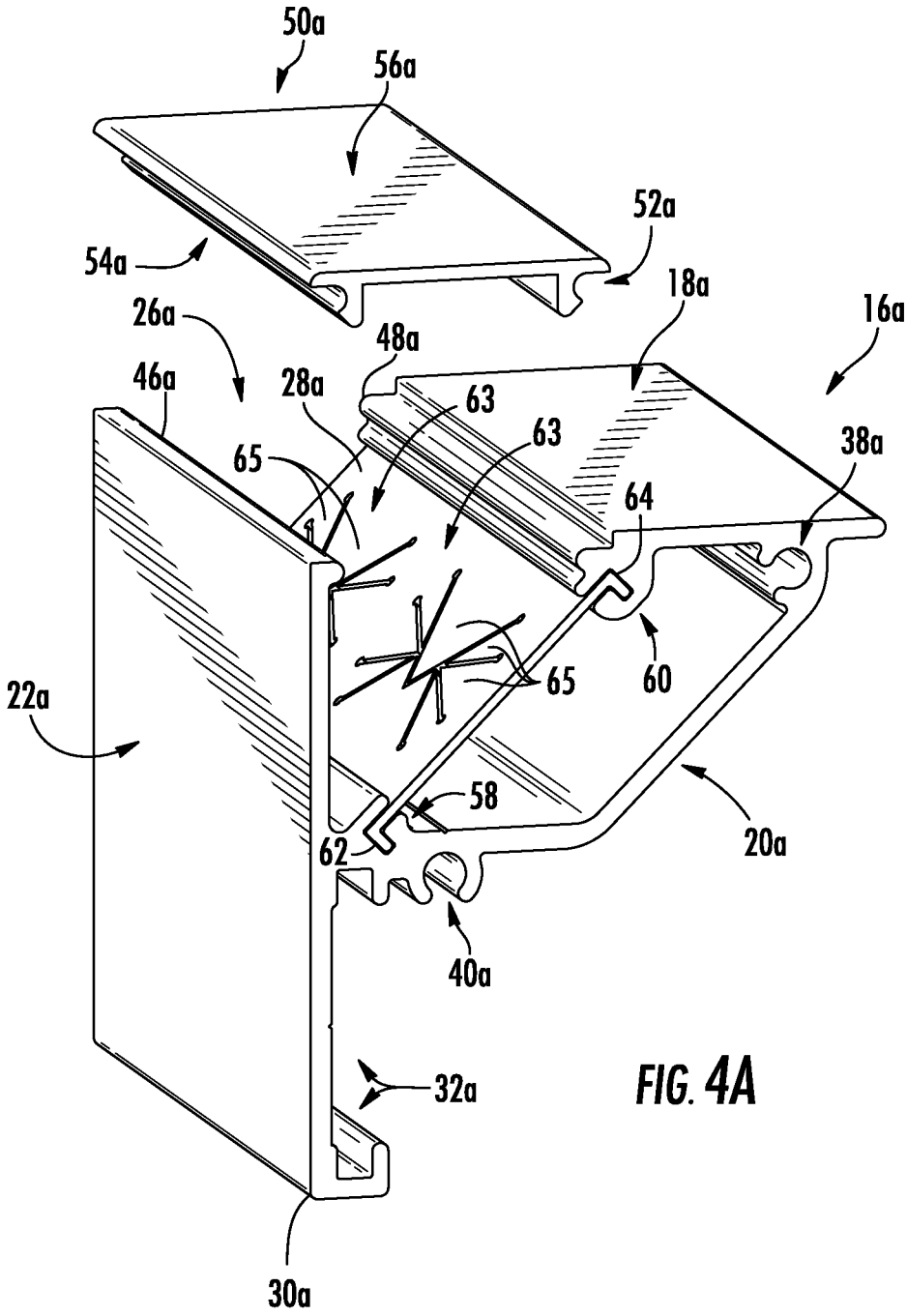
FIG. 4A is a partially exploded perspective view of a portion of a top frame member of the framework of the sign assembly of FIG. 1, and including a portion of a cover element.
Figure 4B:
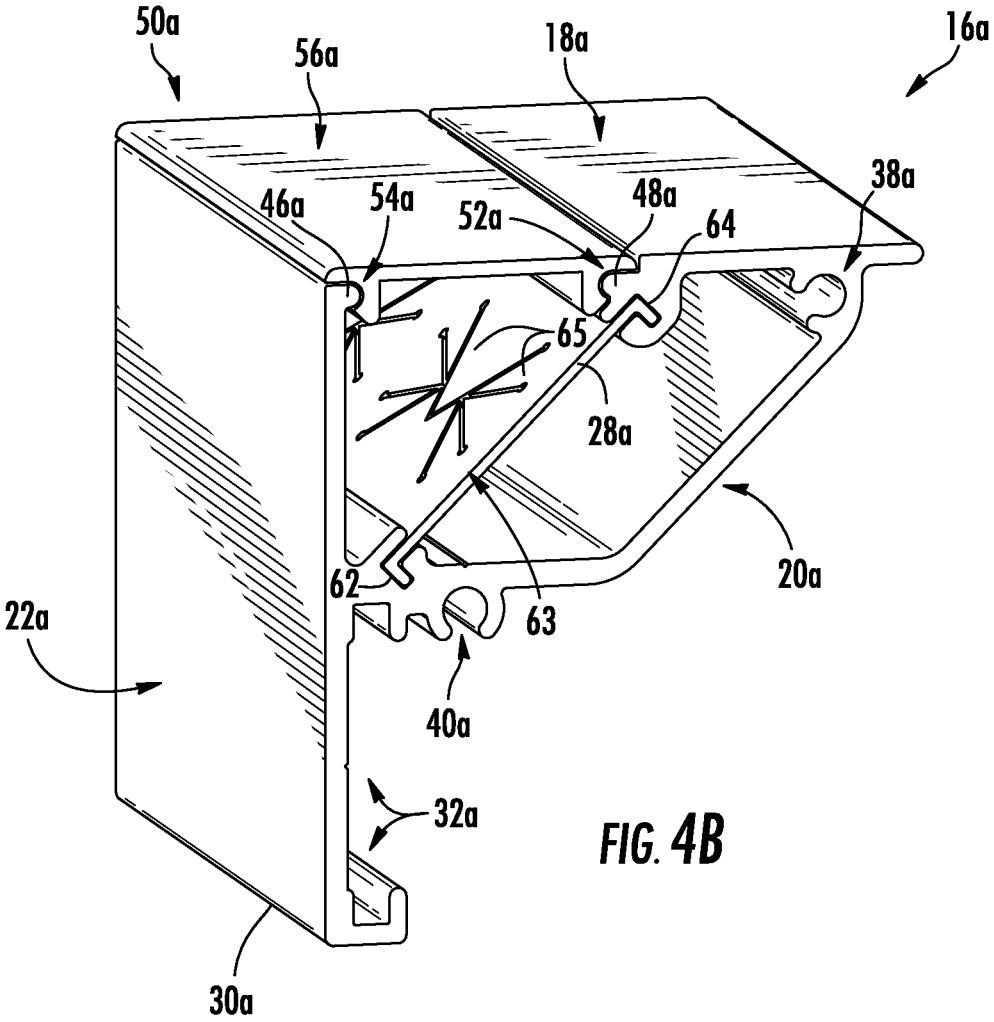
FIG. 4B is another perspective view of the frame member and cover element of FIG. 4A, shown with the cover element installed.
Figure 5A:
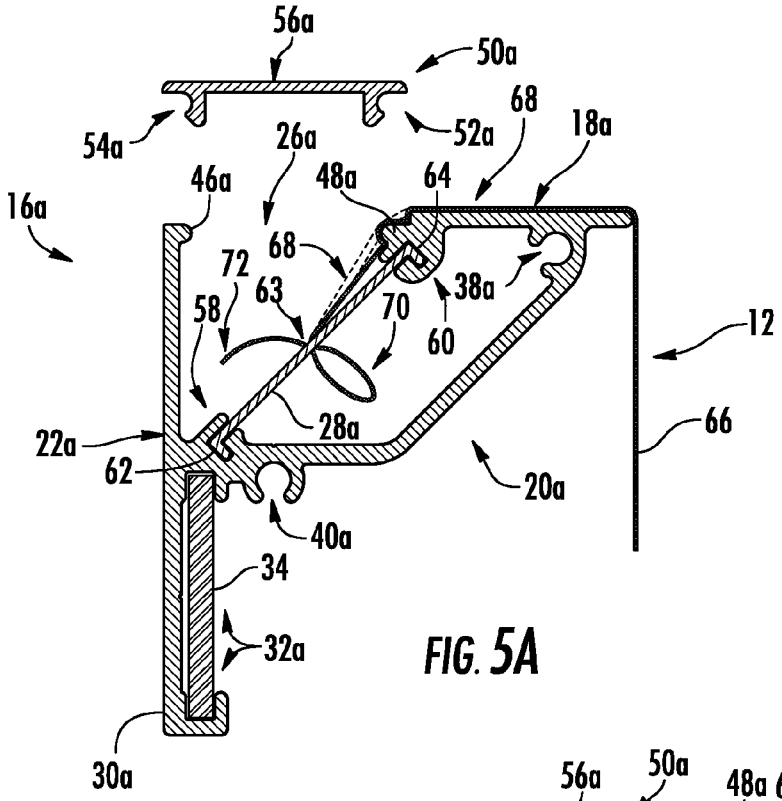
FIG. 5A is a sectional side elevation of a portion of the top frame member, similar to FIG. 4A, and having a display sheet installed.
Figure 5B:
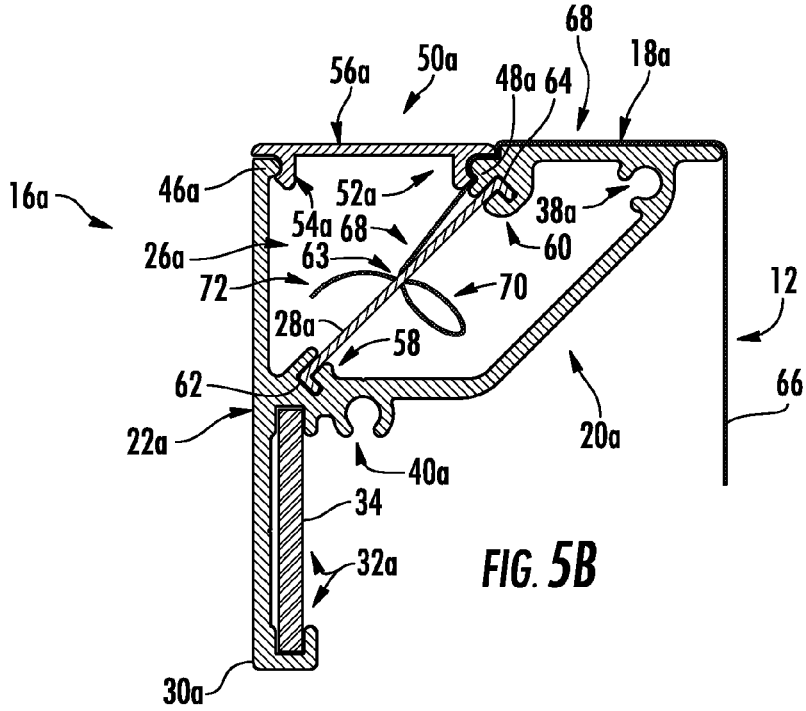
FIG. 5B is another sectional side elevation of the frame member and display sheet of FIG. 5A, with the cover element installed as in FIG. 4B.

Referring now to FIGS. 4A and 4B, the opening of channel 26*a* is defined between a rear contoured surface or lip 46*a* of backing element 30*a* and a middle contoured surface or portion 48*a* that is spaced from rear lip 46*a* and located near outer surface 18*a*. An elongate cover element or cap 50*a* is generally symmetrical about its longitudinal axis, and includes a front contoured portion 52*a* and a rear contoured portion 54*a* that are substantially identical to one another as a mirror image so that cover element 50*a* may be reversible. Front contoured portion 52*a* of cover element 50*a* is shaped in a manner generally corresponding to that of middle contoured surface 48*a* of frame member 16*a*, so that front contoured portion 52*a* can releasably engage or latch to middle contoured surface 48*a*, as in a snap-fit manner. Similarly, rear contoured portion 54*a* has a shape corresponding to that of rear contoured surface or lip 46*a*, so that rear contoured portion 54*a* can releasably engage or latch to rear contoured surface 46*a*, as in a snap-fit manner (FIG. 4B). With cover element 50*a* coupled to frame member 16*a*, an outer surface 56*a* of the cover element is substantially coplanar with outer surface 18*a* of frame member 16*a* (FIGS. 4B and 5B). Thus, elongate cover element 50*a* covers or closes the opening of channel 26*a* to present a clean, finished appearance, and also to aid in securing display sheet 12 to framework 14, as will be described below.

Inside of channel 26*a*, frame member 16*a* includes a rearward retainer support element 58 and a forward retainer support element 60, each of which receives a respective side portion of flexible retainer element 28*a*, such as shown in FIGS. 4A-5B. Each retainer support 58, 60 of frame member 16*a* includes a generally L-shaped channel or recess 62, 64 for receiving the correspondingly-shaped opposite sides of flexible retainer element 28*a*. Each side of the flexible retainer element 28*a* is formed in an L-shape with a 90-degree bend, so that the flexible element 28*a* can be readily slid into secure engagement with frame member 16*a*, before assembling the frame members together, by aligning the opposite L-shaped sides of the flexible retainer element with the L-shaped recesses 62, 64 of retainer supports 58, 60. This permits a central portion of the flexible retainer element 28*a* to span across a portion of channel 26*a*, between retainer support elements 58, 60, at approximately a 45-degree angle relative to the rearwardly-facing surface 22*a* and the outwardly-facing surface 18*a*. Optionally, it is envisioned that retainer elements could be disposed in a channel along inwardly-facing surfaces of a framework, but this would result in increased viewability or exposure of the framework itself, which may be less desirable for at least aesthetic reasons.

It is further envisioned that a flexible retainer element could be supported in the channel of the frame member so as to be substantially parallel to the outwardly-facing surface, and substantially perpendicular to the rearwardly-facing surface. For example, and with reference to FIGS. 6A and 6B, an alternative frame member 116*a* has various shapes and features that generally correspond to those of frame member 16*a*, described above, which are identified by adding 100 to the corresponding reference numerals. Thus, for example, alternative frame member 116*a* includes an outer surface 118*a* generally corresponding to the outer surface 18*a* of frame member 16*a*, and frame member 116*a* also includes a cavity 126*a* (FIG. 6A) with an opening defined between a rear contoured lip 146*a* and a middle contoured surface 148*a*, etc.

Figure 6A:
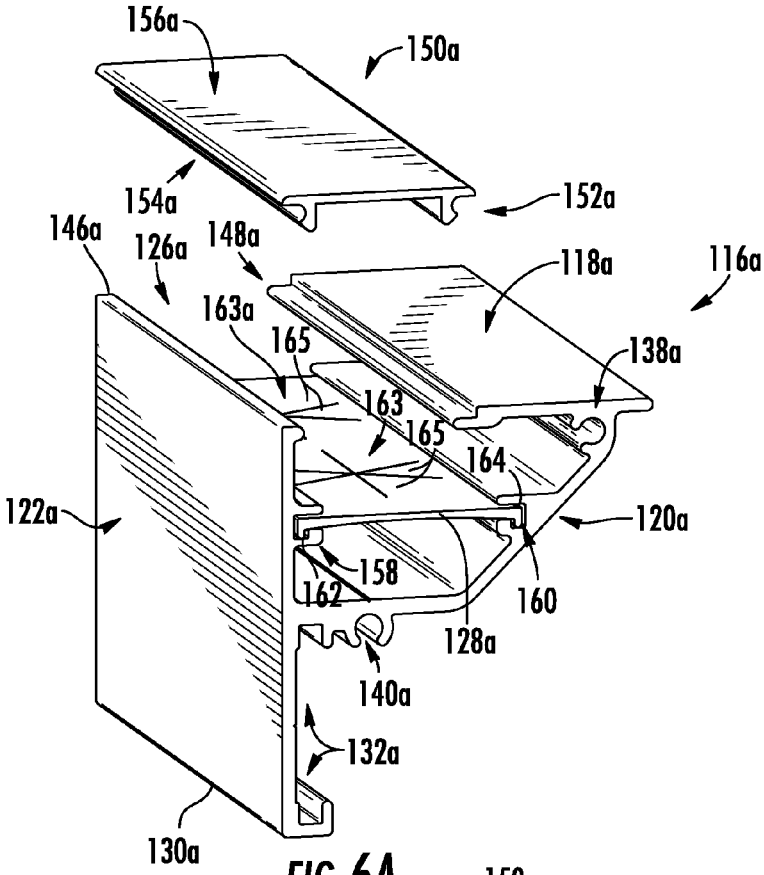
FIG. 6A is a partially exploded perspective view of a portion of an alternative top frame member, and including a portion of a cover element.
Figure 6B:
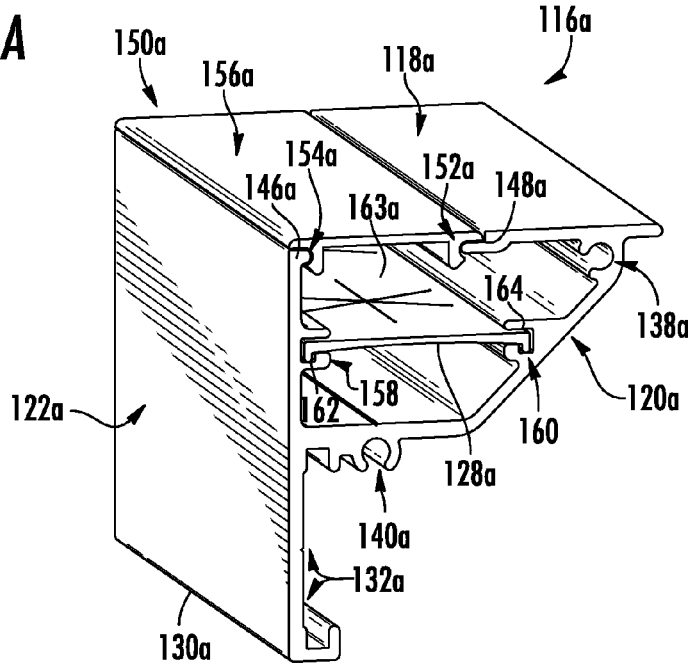
FIG. 6B is another perspective view of the frame member and cover element of FIG. 6A, shown with the cover element installed.

Inside of channel 126*a*, frame member 116*a* includes a rearward retainer support element 158 and a forward retainer support element 160, each of which receives a respective side portion of an alternative flexible retainer element 128*a* (FIGS. 6A-6B). Each retainer support 158, 160 of frame member 116*a* includes a generally L-shaped channel or recess 162, 164 for receiving the correspondingly-shaped opposite sides of flexible retainer element 128*a*. Each side of the flexible retainer element 128*a* is formed in an L-shape with a 90-degree bend, so that the flexible retainer element 128*a* can be readily slid into secure engagement with frame member 116*a*, before assembling the frame members together, by aligning the opposite L-shaped sides of the flexible retainer element with the L-shaped channels 162, 164 of retainer supports 158, 160, so that a central portion of the flexible retainer element 128*a* spans across a portion of channel 26*a,* between retainer support elements 158, 160.

Retainer support elements 158, 160 are arranged so that flexible retainer element 128*a* is mounted substantially parallel with outer surface 118*a*. With flexible retainer element 128*a* mounted parallel to outer surface 118*a*, an installer's fingers or a tool can be pushed through slot patterns 163 in a direction that is substantially parallel to rearwardly-facing surface 122. This can facilitate installation of a display sheet while the framework is installed at a wall or other support surface, such as by preventing interference between the tool (or the installer's fingers) and the wall, as could be more likely to occur when the flexible retainer element 28*a* is mounted at a 45-degree angle (FIGS. 4A-5B).

The flexible retainer elements, including retainer element 28*a* shown in FIGS. 4A-5B, are formed as an extruded strip of flexible and resilient material, such as plastic or polymeric resin or the like. As noted above, the opposite sides of each flexible retainer element 28 are formed in L-shapes with 90-degree bends to facilitate attachment of the retainer element to a respective frame member 16. However, it will be appreciated that other shapes or configurations of opposite sides of the flexible retainer elements, with correspondingly-shaped retainer supports of the frame members, may be used to facilitate their secure attachment to the retainer supports of the frame member, so that the flexible retainer elements can be readily and securely attached during assembly of the framework.

Figure 7:
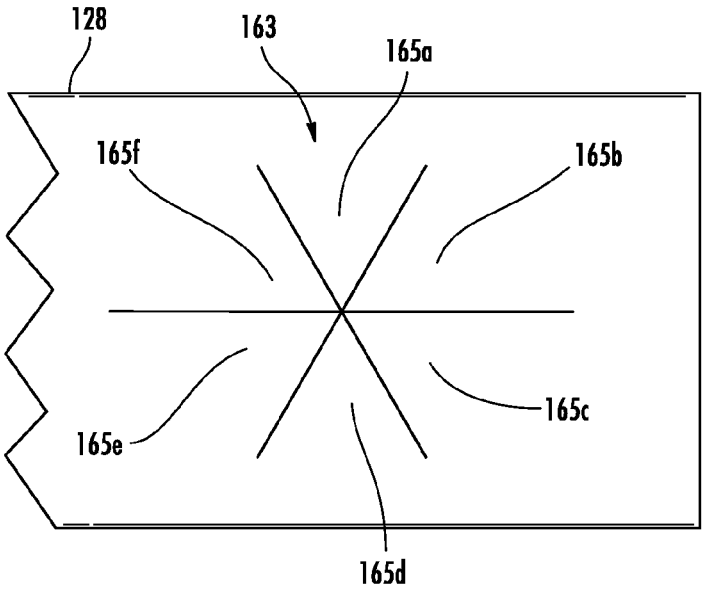
FIG. 7 is a top plan view of a section of an alternative flexible retainer element for use with the sign assembly.

Flexible retainer element 28*a* defines a repeating pattern of slits, slots, and/or openings 63 ("slot patterns 63") to form a plurality of resilient fingers 65 directly inwardly toward the center of each slot pattern 63. It is envisioned that various different slot patterns may be used without departing from the spirit and scope of the present invention, and are not limited to slot pattern 63 of FIGS. 3, 4A, and 4B. For example, and with reference to FIG. 7, alternative flexible retainer element 128 includes a slot pattern 163 with six resilient fingers 165*a-f*. The top and bottom resilient fingers 165*a*, 165*d* are substantially identical to one another and symmetrical, while each of the upper right resilient finger 165*b*, lower right resilient finger 165*c*, lower left resilient finger 165*e*, and upper left resilient finger 165*f* has one side (defined by a slit or slot) that is longer than another. It will be appreciated that the terms "slit pattern" and "slot pattern" are used generically or substantially interchangeably herein to refer to as few as one single slit or slot that is straight, curved or jagged, and up to substantially any number of slits or slots or openings, in substantially any configuration, and that the patterns disclosed herein are merely exemplary.

Resilient fingers 65 and 165*a-f* are flexible and tend to return to a planar configuration when in their relaxed and disengaged state, as shown. However, when a force is applied near the center of a slit or slot pattern, the resilient fingers deflect away from the applied force to create or enlarge the space or spaces between the respective fingers, thus creating an opening of sufficient size to receive a portion of the display sheet 12, as will be described below. Typically, the force applied to each slit or slot pattern is accomplished simply by an installer pushing with their finger, although it will be appreciated that a blunt tool, such as a screwdriver handle or tip, or the blunt end of a writing instrument, could also be used. For example, a tool having a blunt end (so as not to unnecessarily snag or tear the display sheet) and a smooth shaft may be particularly well-suited for urging a portion of the display sheet through the opening of the flexible retainer element, and for cleanly withdrawing the tool without drawing the sheet portion back out of the opening.

Figure 8:
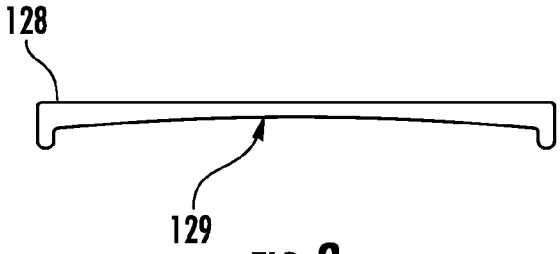
FIG. 8 is an end elevation of the alternative flexible retainer element of FIG. 7.

While flexible retainer element 28*a* is shown having a substantially constant thickness, including the L-shaped side portions (FIG. 4A-5B), the thickness of the extruded strip that forms the flexible retainer element may be varied to affect the strength and resilience or deflectability of the resilient fingers. For example, a bottom surface 129 of flexible retainer element 128 is generally arcuate in shape with the thickest portions formed near the L-shaped opposite sides (FIG. 8). Slot pattern 63, 163 may be die-cut into the respective flexible retainer elements 28, 128 after extrusion, or they may be molded at the same time of forming the flexible retainer elements, for example.

Figure 9:
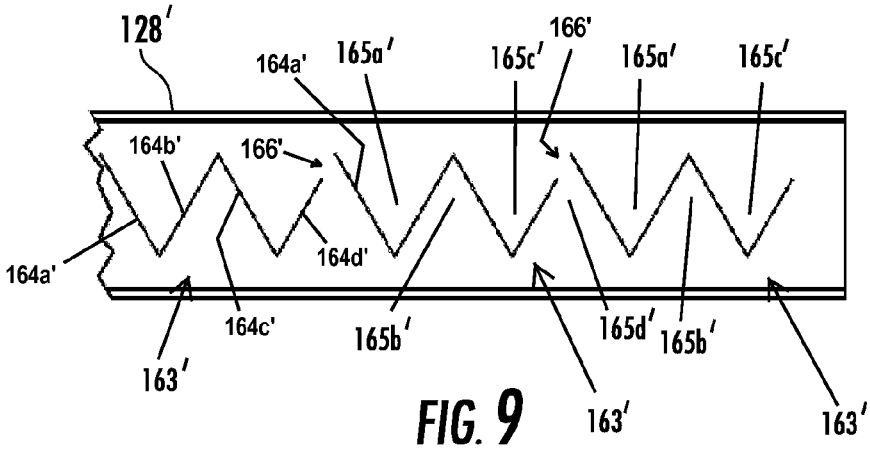
FIG. 9 is a top plan view of a section of another alternative flexible retainer element.
Figure 10:
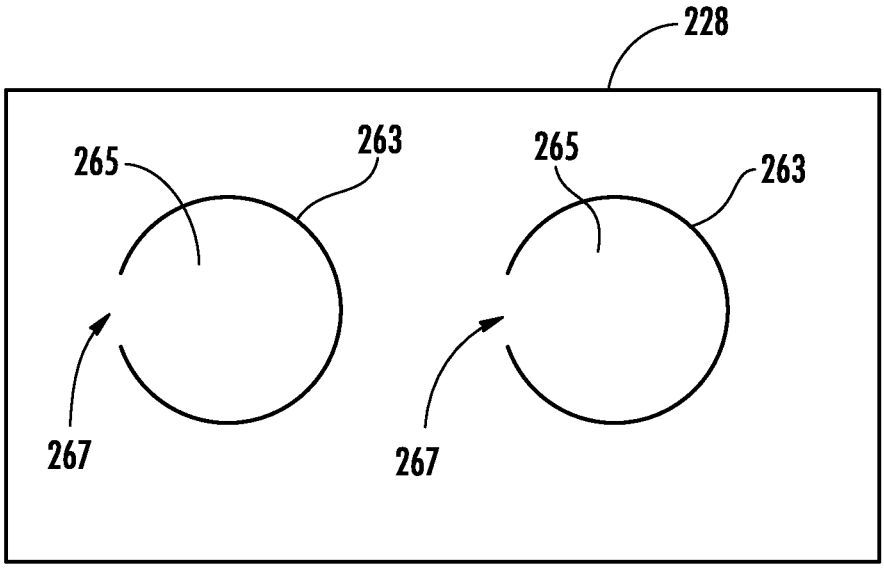
FIG. 10 is a top plan view of a section of another alternative flexible retainer element.

In another embodiment, a flexible retainer element 128' includes a nearly-continuous zigzag pattern made up of a repeating W-shaped slot pattern 163' (FIG. 9). W-shaped slot pattern 163' is formed by four slit legs 164*a'-d'* arranged at angles to one another, with each of the first three slit legs 164*a'-c'* having substantially the same length, and with the fourth slit leg 164*d'* having a somewhat shorter length. The W-shaped slot patterns 163' are arranged so that the fourth slit leg 164*d'* of one pattern is terminated prior to the beginning of the first slit leg 164*a'* of the next pattern, leaving a segment or section 166' of uncut material between adjacent slot patterns 163'.

Each slot pattern 163' thus defines three resilient fingers 165*a'-c'* that are arranged adjacent one another in the longitudinal direction of the retainer element 128'. A first resilient finger 165*a'* is defined between first slit leg 164*a'* and second slit leg 164*b'*, a second resilient finger 165*b'* is defined between second slit leg 164*b'* and third slit leg 164*c'*, and a third resilient finger 165*c'* is defined between third slit leg 164*c'* and fourth slit leg 164*d'*. This allows flexible retainer element 128' to be manufactured, handled, and installed as a single piece, while permitting substantially continuous engagement of the perimeter region of a display sheet between the resilient fingers 165*a'-c'* of the slot patterns 163'. The adjacent longitudinal arrangement of the resilient fingers 165*a'-c'* also allows for an enlarged opening for receiving the display sheet perimeter, which can more readily accept heavier or thicker or less flexible display sheet materials than some of the smaller patterns.

Optionally, segment 166' may define a particularly small uncut space between the adjacent slot patterns 163', or may define a scored line or weakened or frangible region or the like, which is adapted to tear or break open when sufficient force is applied, for example by an installer inserting the perimeter of a display sheet into a slot pattern 163'. In this manner, once flexible retainer element 128' is installed in a framework, two or more adjacent slot patterns 163' can be linked together to provide a substantially continuous zigzag slot pattern along the length of the slot patterns, wherever segments 166' are broken. This creates what becomes a fourth resilient finger 165*d'* between the fourth slit leg 164*d'* of one slot pattern 163' and the first slit leg 165*a'* of an adjacent slot pattern. Since the opposite sides of retainer element 128' are secured by the framework in substantially the same manner as with retainer elements 28, described above, even if a given retainer element 128' is broken entirely apart into two pieces, it will remain supported in the framework and will be capable of engaging and retaining a substantially continuous length of display sheet, rather than only engaging relatively small separate portions of the display sheet's perimeter region.

Other types of flexible retainer elements are also envisioned, including flexible retainer elements with only holes, or with only a single deflecting portion. For example, and with reference to FIG. 9, another flexible retainer element 228 defines a repeating pattern of semi-circular slits 263 that form single resilient fingers 265 that act as a hinged or resilient flap when pressed with a finger or tool. In the illustrated embodiment of FIG. 9, each resilient finger 265 is a semi-circular flap that remains coupled to the remainder of flexible retainer element 228 at a resilient hinge portion 267. When a portion of a display sheet is pushed against finger 265, the finger pivots and deflects at hinge portion 267 to allow part of the display sheet to pass through a resulting hole defined between semi-circular slit 263 and hinge portion 267. It will be appreciated that other single-slit shapes may be also used.

Figure 11:
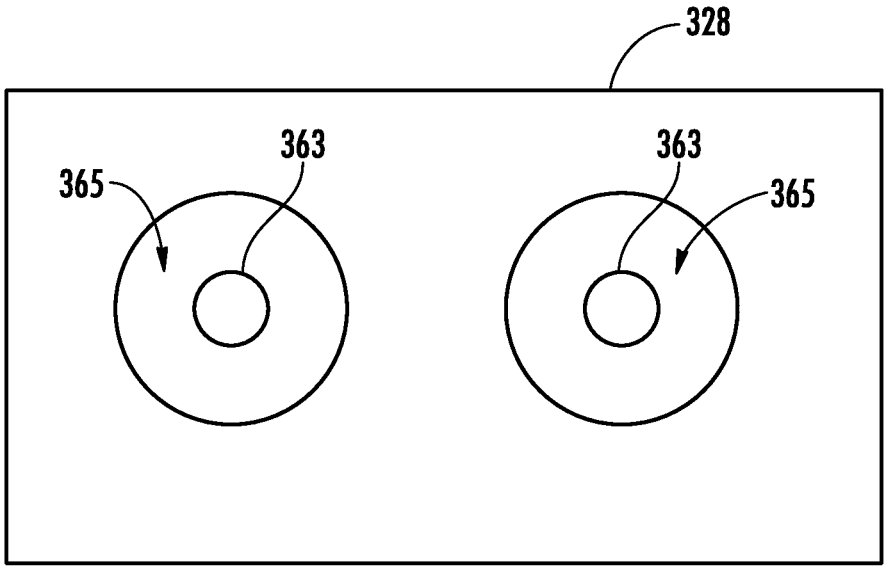
FIG. 11 is a top plan view of a section of still another alternative flexible retainer element.

One alternative to flexible retainer elements having deflectable fingers defined between slits or slots, is envisioned as simple a hole or opening in a retainer element, the retainer element being either rigid or resilient and/or stretchable and elastic. For example, and with reference to FIG. 11, another retainer element 328 defines a repeating pattern of holes 363. Holes 363 may be sufficiently large that an installer's finger or a blunt tool can pass through each hole along with a portion of the display sheet, where the display sheet is sufficiently stiff and/or textured that it is releasably retained at the hole 363 after removal of the finger or tool. Optionally, at least a perimeter region 365 surrounding each hole 363 may be sufficiently flexible or resilient to allow some deflection of the retainer element 328 surrounding the hole 363, to aid insertion of the display sheet. Also, it is envisioned that each perimeter region 365 could be stretchable, so that hole 363 is initially enlarged when the installer inserts a finger or tool with the display sheet, and so that the perimeter region 365 constricts after removal of the finger or tool, to tighten the perimeter region and effectively shrink the hole around the retained portion of the display sheet.

Figure 12:
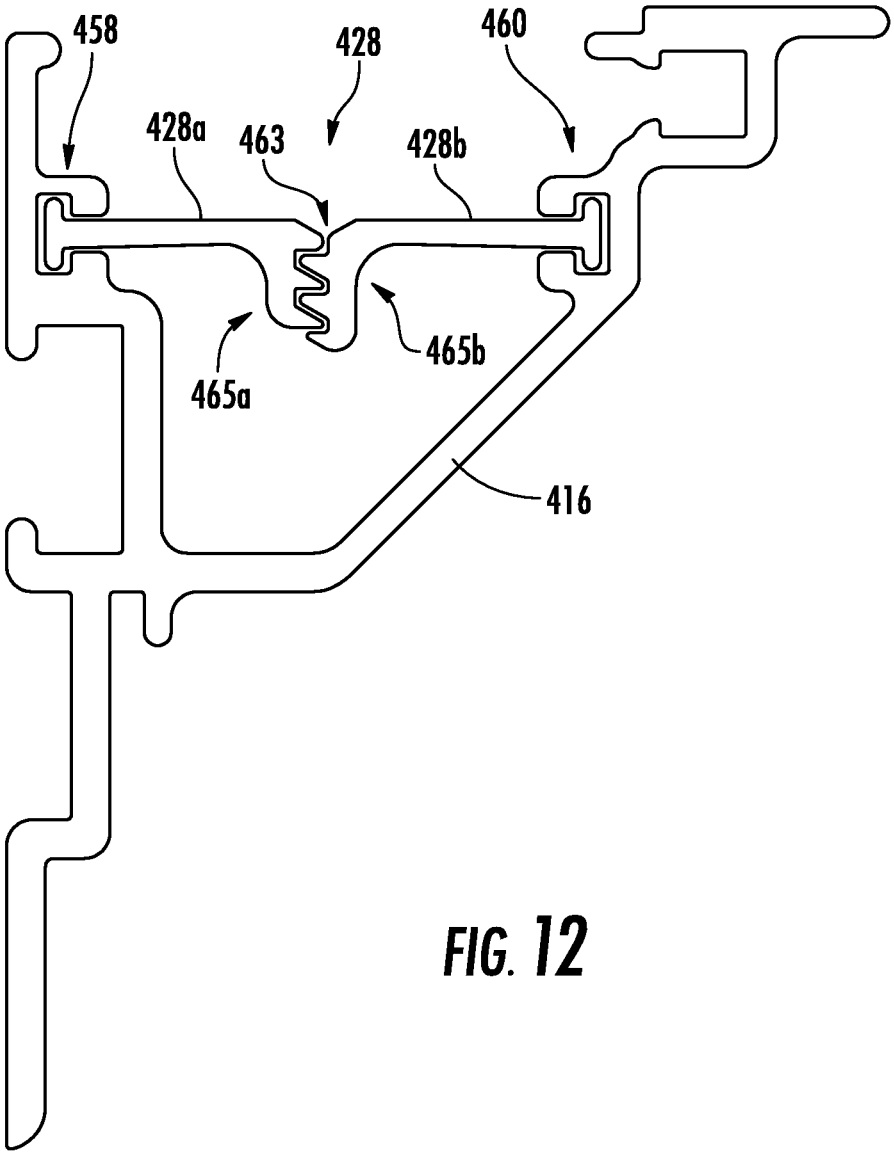
FIG. 12 is a side elevation of a frame member with another alternative flexible retainer element.

Another alternative to the flexible retainer elements described above is a two-piece flexible retainer element 428 including two portions or halves 428*a*, 428*b* that cooperate to form a pinching or retaining region 463 therebetween (FIG. 12). Each portion 428*a*, 428*b* of two-piece flexible retainer element 428 mounts to a frame member 416 at a respective one of a rearward retainer support element 458 and a forward retainer support element 460, in substantially the same manner as described above with respect to other, one-piece flexible retainer elements. Flexible retainer element portions 428*a*, 428*b* include respective distal end portions 465*a*, 465*b* that interlock and give retaining region 463 a zigzag shape, which facilitates retaining a portion of a display sheet in retaining region 463. Flexible retainer element portions 428*a*, 428*b* can be deflected in a similar manner as the resilient fingers of one-piece flexible retainer elements, so that the display sheet can be inserted and removed from retaining region 463 in substantially the same manner. Optionally, the flexible retainer element portions could have substantially identical distal end portions, thus requiring only one production tool to reduce costs and simplify assembly.

Figure 14:
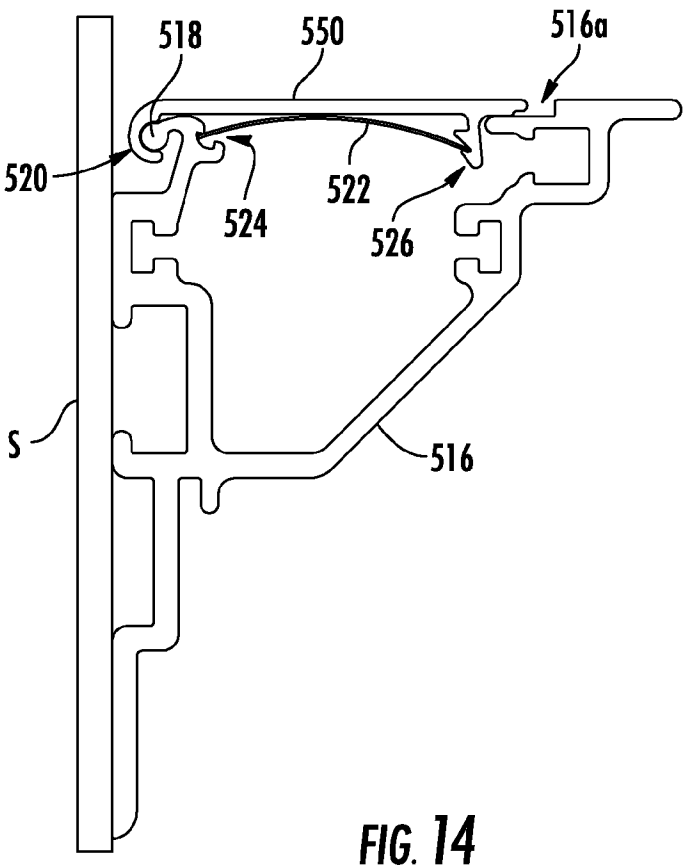
FIG. 14 is another side elevation of the frame member of FIG. 12, with the hinge-mounted cover shown in a closed position.
Figure 13:
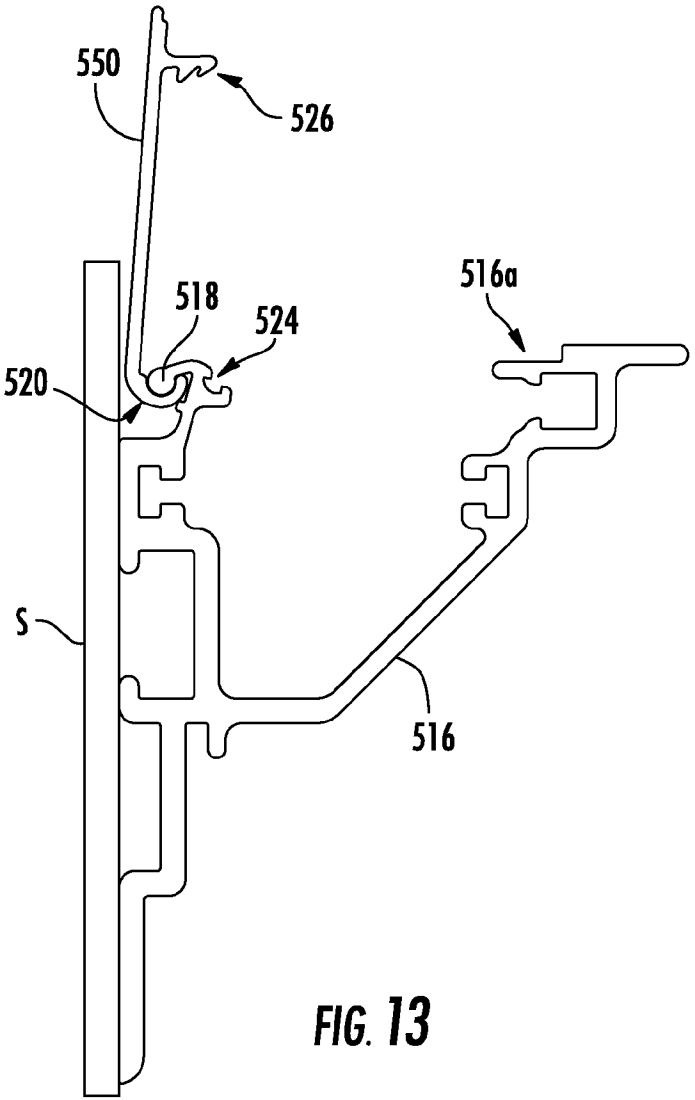
FIG. 13 is a side elevation of another frame member with hinge-mounted cover shown in an open position.

Optionally, a frame member 516 may be fitted with a hinge-mounted cover element 550 that is retained at the frame member when it is moved between open and closed positions, such as shown in FIGS. 13 and 14. In the illustrated embodiment, frame member 516 includes an elongate hinge member 518 that extends along an upper portion or region of the frame member and defines a pivot axis for cover element 550. Cover element 550 includes an elongate hook-shaped receiver portion 520 that extends at least partially around hinge member 518, enabling the cover element 518 to pivot about hinge member 518 between the open position (FIG. 13) and the closed position (FIG. 14). Cover element 550 may be readily removed from hinge member 518 when in the open position, or may be retained at the hinge member when in the open position by a support surface S, such as shown in FIG. 13.

Optionally, cover element 550 is retained in the closed position of FIG. 14 by a resilient biasing element 522 that spans between a first receiving portion 524 of frame member 516 and a second receiving portion 526 of cover element 550 that is positioned across from first receiving portion 524 when cover element 550 is closed. In the illustrated embodiment, biasing element 522 is made of a thin resilient material to function as a leaf spring, which applies a component of spring force to first and second receiving portions 524, 526 that maintains cover element 550 in the closed position until it is manually lifted to the open position of FIG. 13. Upon opening cover element 550, biasing element 522 may apply a force between receiving portions 524, 526 that tends to maintain cover element 550 in the open position until it is manually urged to the closed position. Optionally, the cover element could be shaped to snap into engagement with frame member 516 (such as at flange 516*a*) when the cover element is closed.

Figure 15:
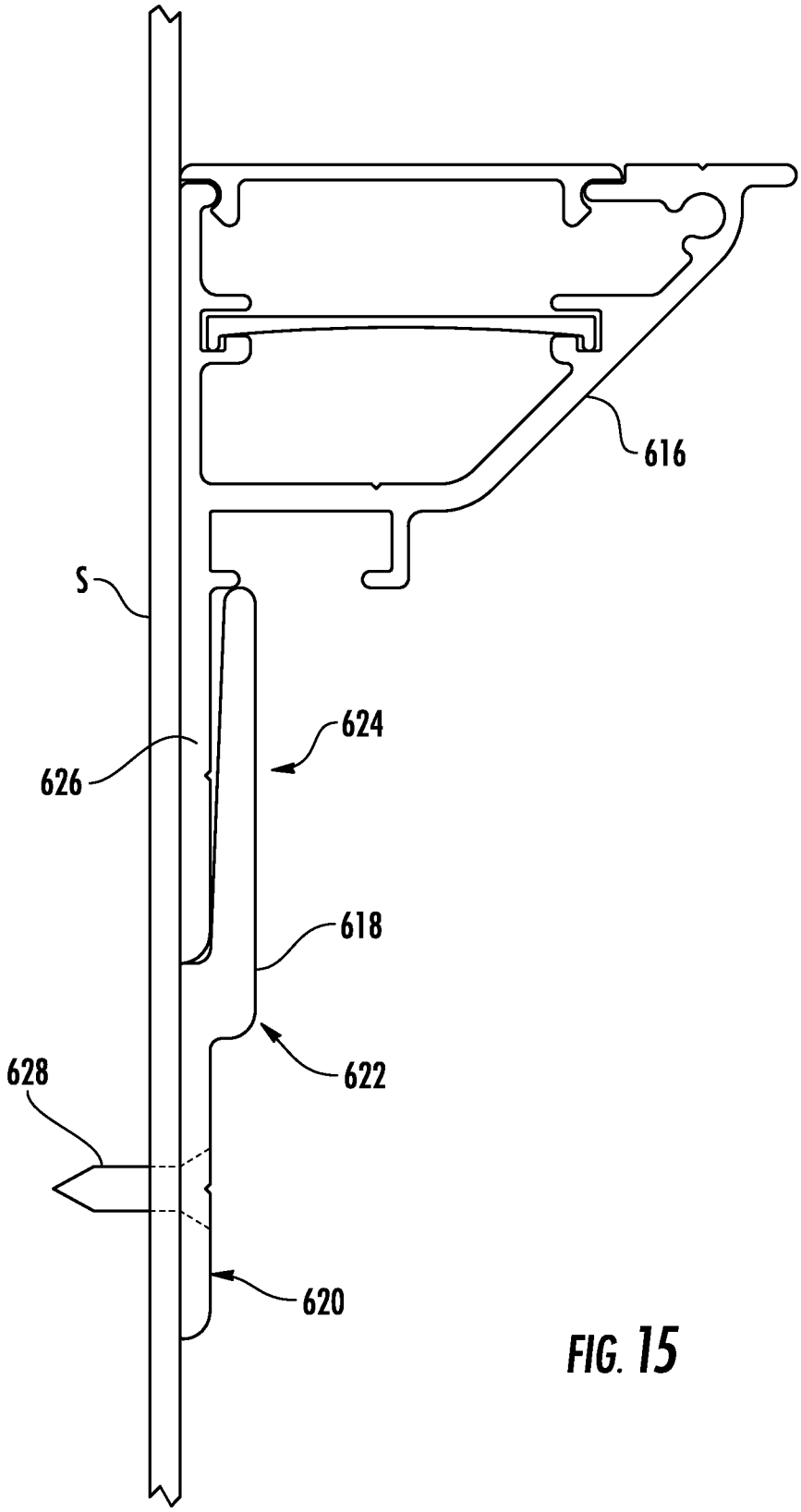
FIG. 15 is a side elevation of another frame member shown supported on a wall bracket.

The frame elements may be attached to a wall or other support surface by nails, bolts, hooks, adhesives, magnetic fasteners, or the like. In one embodiment, it is envisioned that a frame element 616 may be configured to be releasably retained along a wall surface S by an elongate mounting strip 618 (FIG. 15). Elongate mounting strip 618 includes a generally planar wall-engaging portion 620, an offset region 622 that extends outwardly from wall surface S, and a frame-receiving portion 624 that is spaced from wall surface S to receive and support a generally planar mounting portion 626 of frame element 616. Mounting strip 618 is fastened to wall surface S by one or more fasteners 628 that are driven through wall-engaging portion 620 and into wall surface S. Mounting portion 626 of frame element 616 can be readily inserted and removed from the space between wall surface S and frame-receiving portion 624 of mounting strip 618, so that frame element 616 can be readily installed at the wall surface S, or removed therefrom, without the use of tools or removal of fasteners. Typically, only the top frame element would be supported at a mounting strip, as shown, so that the entire weight of the sign assembly can be supported by the mounting strip.

Display sheet 12 includes a central display portion 66 that is typically printed with artwork, signage, or other indicia (not shown). As best seen in FIGS. 5A and 5B, an outer perimeter portion 68 of display sheet 12 may also have an image or artwork printed thereon, and is configured to wrap around the outer surfaces 18 of frame members 16, with the outermost portions of outer perimeter portion 68 received in channels 26 for engagement with slot patterns 63 of flexible retainer elements 28. Typically, display sheet 12 is made from a substantially continuous layer of fibers, textile, cloth, or fabric which may be a natural or synthetic material, such as woven cotton, polyester, nylon, or substantially any other woven or non-woven cloth or fabric or other sheet material that can be colored, dyed or printed in a desired pattern. However, the entirety of display sheet 12 need not be the same material, and in particular, central display portion 66 could be a non-fabric or non-cloth material, such as a plastic sheet or similar. However, it is preferred that at least outer perimeter portion 68 is made of a flexible cloth or textile, cloth-like material, or other flexible material that can be readily engaged and retained to a sufficient extent at slot patterns 63 via engagement with resilient fingers 65.

Once framework 14 is assembled, such as in the rectangular configuration of FIG. 1, display sheet 12 can be readily installed without the use of tools, although a blunt tool could be used to facilitate installation as described above. To install display sheet 12, at least one side of the display sheet's outer perimeter portion 68 is arranged along the respective outer surface 18 and positioned so that central display portion 66 is at least approximately in the proper alignment on the framework 14. Outer perimeter portion 68 is laid over the outer surface 18*a* of frame member 16*a*, extended over middle contoured surface 48*a*, and its remainder is placed into channel 26*a*.

Wherever a part of outer perimeter portion 68 overlies a slot pattern 63, the installer pushes against that part of outer perimeter portion 68 to deflect the resilient fingers 65 and urge that part of outer perimeter portion 68 through the enlarged opening formed through resilient fingers 65 at slot pattern 63. This action leaves a retained portion 70 of the outer perimeter portion 68 of display sheet 12 extending through slot pattern 63 so that it projects through the opposite or inner side of flexible retainer element 28*a*, such as shown in FIGS. 5A and 5B. Typically, and as shown in FIGS. 5A and 5B, an outermost perimeter edge portion 72 of outer perimeter portion 68 of display sheet 12 remains loose and untethered within channel 26*a*, to facilitate later adjustment or removal of the display sheet. The display sheet 12 can be simultaneously tensioned and engaged with slot patterns 63 of the flexible retainer element 28 by an installer frictionally engaging the hands along the outer perimeter portion 68 of display sheet 12, at the outer surface 18 of a given frame member 16, to slide the display sheet along the outer surface 18 while leaving the fingers (or a tool) free to press parts of outer perimeter portion 68 through respective slot patterns 63.

Once at least some of the slot patterns 63 are so engaged, the process may be repeated along the entire perimeter of framework 14. As adjustments are needed, such as to perfect the alignment of central display portion 66, or to smooth any wrinkles, for example, the installer may choose to urge more material of outer perimeter portion 68 through one or more of the slot patterns 63 to either tighten or shift the display sheet 12 in that particular region. If the display sheet 12 needs to be loosened in a particular area, this may be accomplished simply by pulling on the display sheet at its outer perimeter portion 68 and/or its outermost perimeter edge portion 72 to reduce the amount of material at retained portion 70. If complete replacement of display sheet 12 is desired, the display sheet may be readily released from framework 14 simply by pulling on the outermost perimeter edge portion 72 to release the material of retained portions 70 from slot patterns 63. The resilient fingers 65 can deflect in either direction to retain or release the display sheet, depending on the amount of tension or pulling force is applied to the sheet in the vicinity of each slot pattern 63.

To further retain display sheet 12 at framework 14, and to present a more finished appearance as discussed above, elongate cover elements 50 may be snap-fit into position at the opening of channel 26*a*, via engagement of front and rear contoured portions 52*a*, 54*a* with rear contoured lip 46*a* and middle contoured surface 48*a*, respectively. The act of attaching cover element 50 sandwiches or clamps part of outer perimeter portion 68 of display sheet 12 between front contoured portion 52*a* of cover element 50 and the middle of contoured surface 48*a* of frame member 16*a*, such as shown in FIG. 5B. It should be noted that, typically, outer perimeter portion 68 of display sheet 12 will not conform to middle contoured surface 48*a* of frame member 16*a* prior to installation of cover element 50*a*, such as shown in FIG. 5A, but instead would assume a more angular shape once the material of outer perimeter portion 16 is made taut, which is represented in dashed lines in FIG. 5A.

Once display sheet 12 is properly aligned and made sufficiently taut so that substantially no wrinkles are present, and cover elements 50 are installed, sign assembly 10 is ready for installation by mounting to a wall or other support surface (such as a post or other substructure, and/or to one or more other sign assemblies to create a two-sided or polygonal sign assembly) in a conventional manner if it is not already so mounted. The display sheet 12 can be readily replaced or adjusted in the manner described above, either with or without the use of tools. With framework 14 assembled, display sheet 12 can be adjusted or replaced simply by removing one or more of the cover elements 50 and adjusting the tension of the outer perimeter portion 68 of display sheet 12 in the vicinity of one or more slot patterns 63, and then reattaching the cover element(s) 50. This may be accomplished with framework 14 still supported on a wall or other surface or substructure, or the framework may be removed and placed on a table or other work surface if desired.

Thus, the sign assembly of the present invention provides a substantially rigid framework for supporting a flexible display sheet in a manner that facilitates quick adjustment or replacement of the display sheet without need for tools. The display sheet wraps around an outer portion of the framework and enters a channel, where it is releasably retained at a flexible retainer element disposed in the channel. The flexible retainer element may be a strip of resilient sheet material defining one or more slit or slot patterns and/or openings that releasably engage portions of the perimeter of the display sheet. A cover element may be used to cover the channel and to present a finished appearance along the outside portion of the framework. The resulting sign is typically light weight and easily serviced by a single person, and the display sheet may be replaced or adjusted as desired without removing the sign assembly from a wall or other support surface.

Changes and modifications in the specifically described embodiments can be carried out without departing from the principles of the present invention, which is intended to be limited only by scope of the appended claims, as interpreted according to the principles of patent law, including the doctrine of equivalents.

The invention claimed is:

1. A sign assembly comprising:

a framework defining a perimeter region, said framework including at least one frame member having an outer surface and a channel in said outer surface;

a display sheet including a display portion, an outermost perimeter edge portion substantially surrounding said display portion, and an engagement portion spaced inwardly from said outermost perimeter edge portion, wherein at least said engagement portion comprises a flexible sheet material, and wherein a portion of said display sheet is configured to be positioned over at least a portion of said outer surface of said frame member with said engagement portion of said display sheet disposed in said channel of said frame member;

a flexible elongate retainer element comprises a flexible strip mounted in said channel of said at least one frame member, said flexible elongate retainer element comprising a plurality of areas in the form of a repeating series of slot patterns configured for frictionally and releasably engaging respective areas of said engagement portion of said display sheet; and wherein said slot patterns each define a plurality of finger portions of said flexible strip, said finger portions configured to deflect at each of said slot patterns to form an opening when said engagement portion of said display sheet is urged at least partially through said slot patterns formed in said flexible retainer element.

2. A sign assembly comprising:

a framework defining a perimeter region, said framework including at least one frame member having an outer surface and a channel in said outer surface;

an elongate and generally planar flexible retainer element mounted in said channel of said at least one frame member, said flexible retainer element defining a plurality of openings in spaced arrangement;

a display sheet including a display portion and an engagement portion, wherein at least said engagement portion comprises a flexible sheet material, wherein a portion of said display sheet is configured to be positioned over at least a portion of said outer surface of said frame member with said engagement portion of said display sheet disposed in said channel of said frame member; and wherein said flexible retainer element is configured to releasably engage respective portions of said engagement portion of said display sheet at respective ones of said plurality of openings when said respective portions of said engagement portion are urged at least partially through said flexible retainer element.

3. The sign assembly of claim 1, wherein said engagement portion comprises a fabric or fabric-like material.

4. The sign assembly of claim 3, wherein the entirety of said display sheet comprises said fabric or fabric-like material.

5. The sign assembly of claim 1, wherein said at least one frame member comprises left and right frame members spaced from one another and top and bottom frame members spaced from one another, said top and bottom frame members being joined to said left and right frame members to form a rectangular framework.

6. The sign assembly of claim 1, wherein said repeating series of said slot patterns includes at least two adjacent ones of said slot patterns, and wherein said flexible strip defines a frangible region between said adjacent ones of said slot patterns, said frangible region configured to break or tear open upon the application of sufficient force to thereby join said adjacent ones of said slot patterns.

7. The sign assembly of claim 1, wherein said flexible retainer element comprises an elastic portion defining an opening, and wherein said elastic portion stretches to enlarge said opening and impinge on said engagement portion of said display sheet when said engagement portion is urged at least partially through said opening.

8. The sign assembly of claim 1, further comprising a cover element configured to cover said channel of said at least one frame member.

9. The sign assembly of claim 8, wherein said cover element is snap-fit to said at least one frame member at said channel.

10. The sign assembly of claim 8, wherein said cover element is pivotally coupled to said at least one frame member, and is movable between an open position in which said channel is exposed and a closed position in which said channel is covered by said cover element.

11. The sign assembly of claim 8, wherein a portion of said display sheet is engaged between a portion of said cover element and a portion of said at least one frame member to thereby at least partially retain said display sheet at said at least one frame member.

12. The sign assembly of claim 1, wherein said flexible retainer element is arranged substantially parallel to said outer surface of said frame member.

13. A sign assembly comprising:

at least two frame members having respective outer surfaces defining respective outwardly-facing channels;

a flexible elongate strip mounted in said outwardly-facing channel of each of said frame members, said flexible strip comprising a plurality of slot patterns, each of said slot patterns defining a region in which portions of said flexible strip are deflectable to form openings at said slot patterns;

a display sheet comprising a flexible material and having a perimeter region including an outermost perimeter edge portion and an engagement portion spaced inwardly from said outermost perimeter edge portion, wherein an inboard portion of said perimeter region of said display sheet is positioned over said outer surfaces of said frame members with said engagement portion and said outermost perimeter edge portion of said perimeter region of said display sheet disposed in said outwardly-facing channel of said frame member, and with said engagement portion of said display sheet releasably and frictionally retained at said slot patterns of said flexible strip;

a cover element disposed along at least one of said frame members at said outer surface for at least partially covering said outwardly-facing channel; and wherein said display sheet is further engaged between a portion of said cover element and a portion of said at least one frame member to thereby at least partially retain said display sheet at said at least one of said frame members.

14. The sign assembly of claim 13, comprising two of said cover elements, each of said cover elements being snap-fit to a respective one of said at least two frame members at said outwardly-facing channels.

15. The sign assembly of claim 13, wherein said at least two frame members are coupled to one another.

16. The sign assembly of claim 15, wherein said at least two frame members comprise left and right frame members spaced from one another and top and bottom frame members spaced from one another, said top and bottom frame members being joined to said left and right frame members to form said framework in a rectangular shape.

17. A sign assembly comprising:

a framework defining a perimeter region, said framework including at least one frame member having an outer surface and defining a channel in said outer surface;

a display sheet including an outermost perimeter edge portion and an engagement portion spaced inwardly from said outermost perimeter edge portion, said engagement portion comprising a flexible fabric or fabric-like material, wherein said display sheet is wrapped around at least a portion of said perimeter region of said framework;

a flexible retainer element mounted in said channel of said at least one frame member and comprising a pair of separate retainer element portions having respective distal end portions arranged in close proximity, said flexible retainer element defining at least a portion of a slit or opening between said distal end portions for receiving said engagement portion of said display sheet; and wherein said flexible retainer element is configured to releasably and frictionally engage said engagement portion of said display sheet when regions of said engagement portion are urged at least partially through said slits or openings defined by said flexible retainer elements.

18. The sign assembly of claim 17, wherein said flexible retainer elements comprise a flexible and resilient sheet material that defines a plurality of said slits or openings for receiving respective ones of said regions of said engagement portion of said display sheet.

19. A method of assembling a sign, said method comprising:

wrapping an outer perimeter region of a display sheet around outer surfaces of a framework, the perimeter region of the display sheet comprising an outermost perimeter edge portion substantially surrounding a display portion, and an engagement portion spaced inwardly from the outermost perimeter edge portion;

urging the engagement portion of the perimeter region of the display sheet into channels formed in the framework and through respective ones of a plurality of openings formed in spaced arrangement along flexible retainer elements that are disposed along the framework; and releasably and frictionally retaining portions of the engagement portion of the perimeter region of the display sheet at respective ones of the plurality of openings formed in the flexible retainer elements.

20. The sign assembly of claim 2, wherein said engagement portion of said display sheet comprises an outer perimeter region of said display sheet.

21. The sign assembly of claim 2, wherein said plurality of openings defined by said flexible retainer element are formed by respective slot patterns, each of said slot patterns defining a plurality of finger portions, and wherein said finger portions of said flexible retainer element deflect at said slot patterns to form said openings when said respective portions of said engagement portion of said display sheet are urged at least partially through said slot patterns.

22. The sign assembly of claim 21, wherein said flexible retainer element defines a frangible region between adjacent ones of said slot patterns, said frangible region configured to break or tear open upon the application of sufficient force to thereby join said adjacent ones of said slot patterns.

* * * * *